United States Patent [19]

Hellwig et al.

[11] 4,384,236

[45] May 17, 1983

[54] ELECTRIC LAMP WITH A SLEEVE-SHAPED CAP

[75] Inventors: Paul Hellwig; Werner Schlagheck, both of Aachen, Fed. Rep. of Germany

[73] Assignee: U.S. Philips Corporation, New York, N.Y.

[21] Appl. No.: 176,313

[22] Filed: Aug. 8, 1980

[30] Foreign Application Priority Data

Aug. 17, 1979 [DE] Fed. Rep. of Germany ..... 2933359

[51] Int. Cl.[3] ..... H01J 5/48; H01J 5/50

[52] U.S. Cl. ..... 313/318; 313/315; 339/144 R

[58] Field of Search ..... 313/315, 318; 339/144 R, 144 T, 145 R

[56] References Cited

U.S. PATENT DOCUMENTS

| | | | |
|---|---|---|---|
| 3,262,001 | 7/1966 | Rijckeart | 313/318 X |
| 3,530,330 | 9/1970 | Dupree | 313/318 |
| 3,534,217 | 10/1970 | Uause et al. | 313/318 |
| 3,611,258 | 10/1971 | Kolakowski | 313/318 |
| 3,885,185 | 5/1975 | Tilley | 313/315 |
| 3,898,506 | 8/1975 | Wright | 313/318 |
| 4,039,886 | 8/1977 | Scherzer | 313/318 |
| 4,295,076 | 10/1981 | Eckhardt et al. | 313/318 |

*Primary Examiner*—Saxfield Chatmon, Jr.
*Attorney, Agent, or Firm*—Robert S. Smith

[57] ABSTRACT

In an electric lamp with a sleeve-shaped cap 12, in which an inner part 8, fitted to accommodate the lamp bulb 1, consists of a cover plate 9 with at least two spring clips 10 attached to the inside wall of the cap 2 and provided with openings 11, the sleeve-shaped cap 12 is provided with at least two projections 13 protruding inwards, over which, when the inner part 8 is inserted into the cap 12, the spring clips 10 fit and lock into position, by means of the openings 11 which correspond to the cross-section of the projections.

3 Claims, 12 Drawing Figures

ELECTRIC LAMP WITH A SLEEVE-SHAPED CAP

The invention relates to an electric lamp with a lamp bulb and a sleeve-shaped cap, in which an inner part is present, fitted to accommodate the lamp bulb. The inner part consists of a cover plate with at least two spring clips extending along the inside wall of the cap and provided with openings which engage elements protruding from the cap.

In a lamp of this type, known from French Patent Specification 769 029, the inner part has three spring clips, which are provided with relatively large elongated openings. After the inner part has been inserted into the lamp cap, hollow rivets are put through holes in the cap sleeve until they come through the openings in the clips, and lightly riveted so that the inner part is still quite adjustable in relation to the cap; this being used for aligning the lamp. After alignment, the cap and the inner part are joined together by soldering or welding. However, such connections are troublesome and expensive, particularly with small lamps. There is also the problem that the material may be destroyed during this treatment if low wall thicknesses are used.

The invention is therefore based on the problem of making an electric lamp, whose cap and inner part can be joined together without additional heat treatment, such as welding or soldering.

In the case of an electric lamp of the aforementioned type according to the invention, this problem is solved by the elements protruding from the sleeve-shaped cap being formed in the shape of projections integral with the cap, over which projections, when the inner part is inserted into the cap, the spring clips fit and lock into position, by means of the openings which correspond to the cross-section of the projections.

In this way a purely mechanical securing of lamp cap and inner part is achieved, both in the direction of rotation and in the longitudinal direction.

By preference the projections are formed by pressing portions of the metal cap sleeve inwards. However, the projections may also be formed in the shape of inwardly-protruding pins fixed to the cap.

So as to prevent the inner part's clips from slipping once they have sprung into position over the cap projections and thus preventing the inner part from coming loose from the cap, the lamp bulb in one advantageous embodiment according to the invention has a pinch with basically rectangular cross-section, extending into the cap at least as far as the projections, and arranged with at least one of its minor lateral faces situated in such a way in relation to one of the inner part's spring clips, that its distance from the projection protruding through the clip opening is less than the thickness of this clip. In this case the inner part, together with its spring clips, must be put into the cap and there locked into place by means of the projections, before the lamp bulb is fixed in the inner part.

The lamps according to the invention may be incandescent lamps which are used in motor vehicles, such as rear lights or blinkers.

Two embodiments of lamps according to the invention are now discussed in greater detail on the basis of the diagram:

Figure 1:
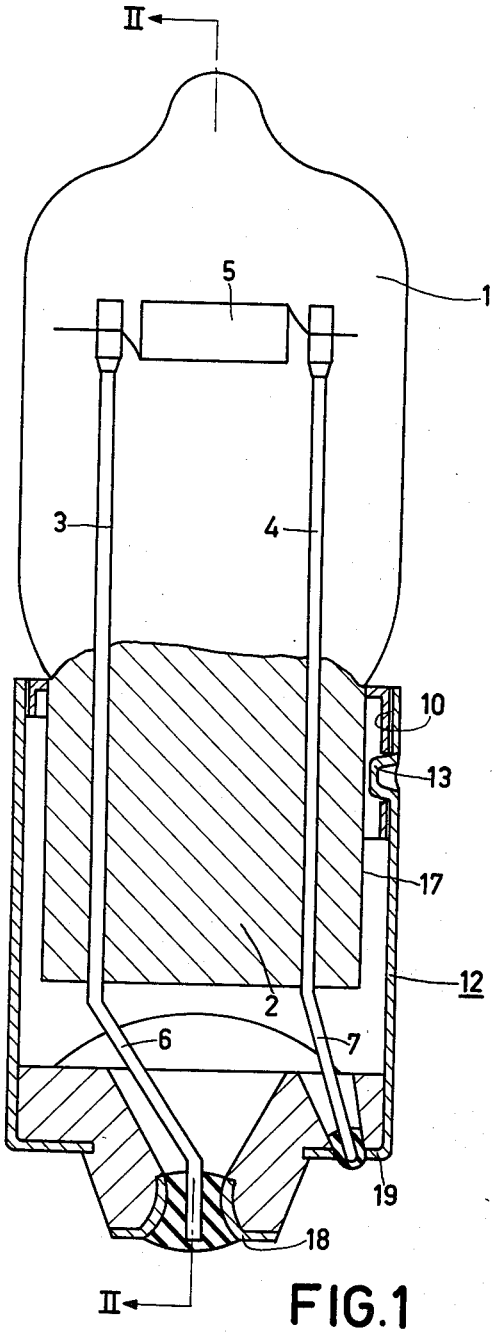
FIG. 1 shows a longitudinal section through an incandescent lamp, whose bulb is situated in an inner part which is accommodated in a cap.
Figure 2:
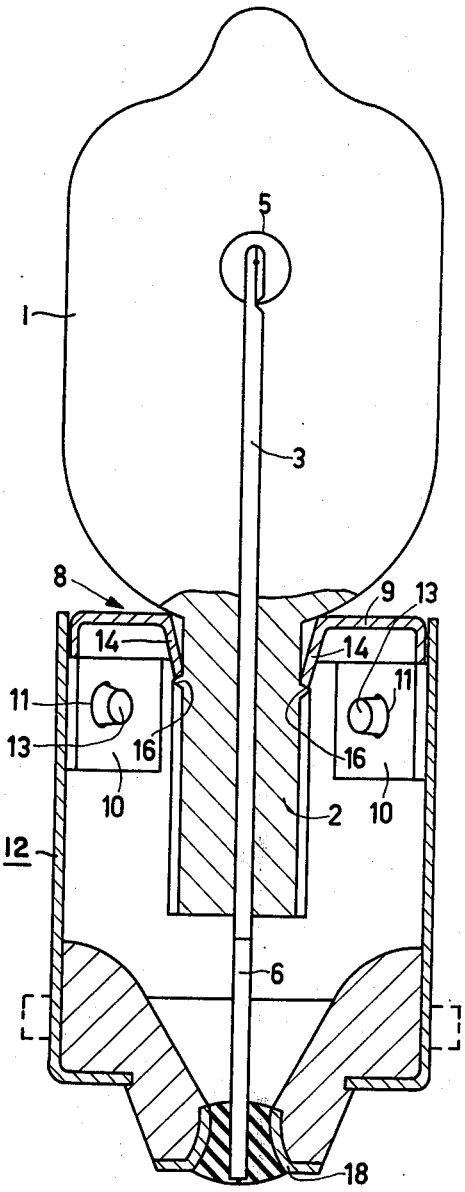
FIG. 2 shows a longitudinal section through the lamp of FIG. 1 along the line II—II.

In FIGS. 1 and 2, 1 is a bulb, made from hard glass, in a small halogen incandescent lamp, which has at its end a pinch 2, generally rectangular in cross-section, in which are embedded power leads 3 and 4 which lead to a filament coil 5 and whose ends 6 and 7 protrude from the pinch 2.

Figure 4:
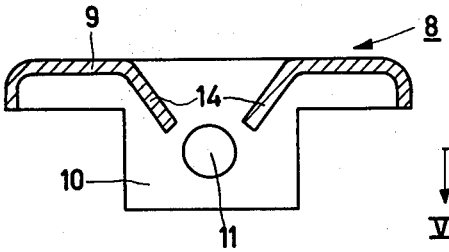
FIG. 4 shows a longitudinal section through the inner part of FIG. 3 along the line IV—IV.
Figure 5:
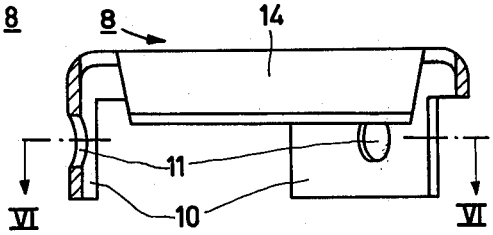
FIG. 5 shows a longitudinal section, turned through 90°, through the inner part along the line V—V in FIG. 4.
Figure 3:
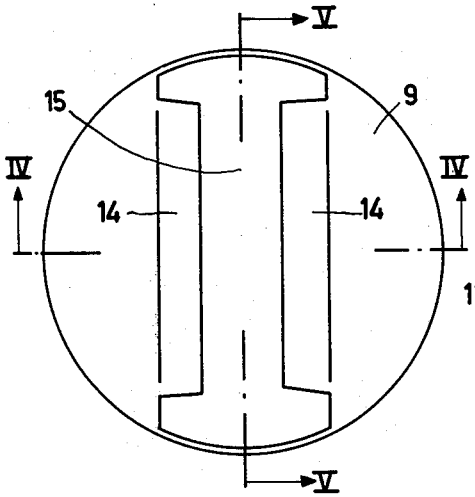
FIG. 3 shows a top view on to the inner part of the lamp of FIGS. 1 and 2, in larger scale.
Figure 6:
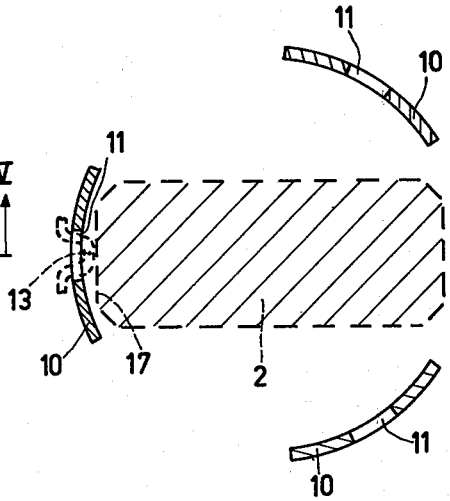
FIG. 6 shows a cross-section through the inner part along the line VI—VI of FIG. 5.
Figure 7:
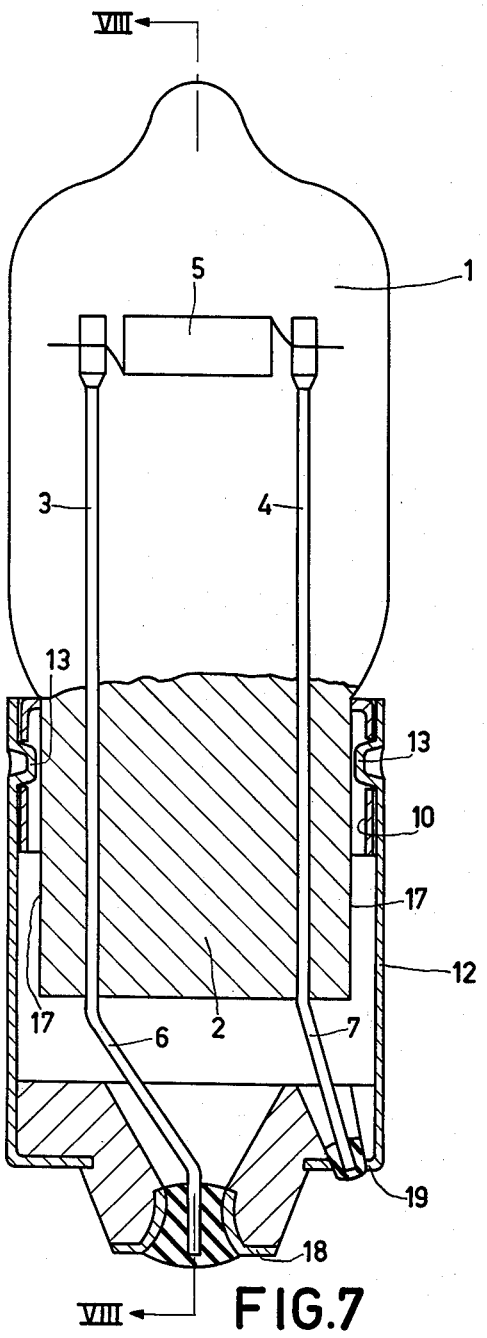
FIGS. 7 and 8 show two longitudinal sections, turned through 90°, of an incandescent lamp with a different type of inner part.
Figure 8:
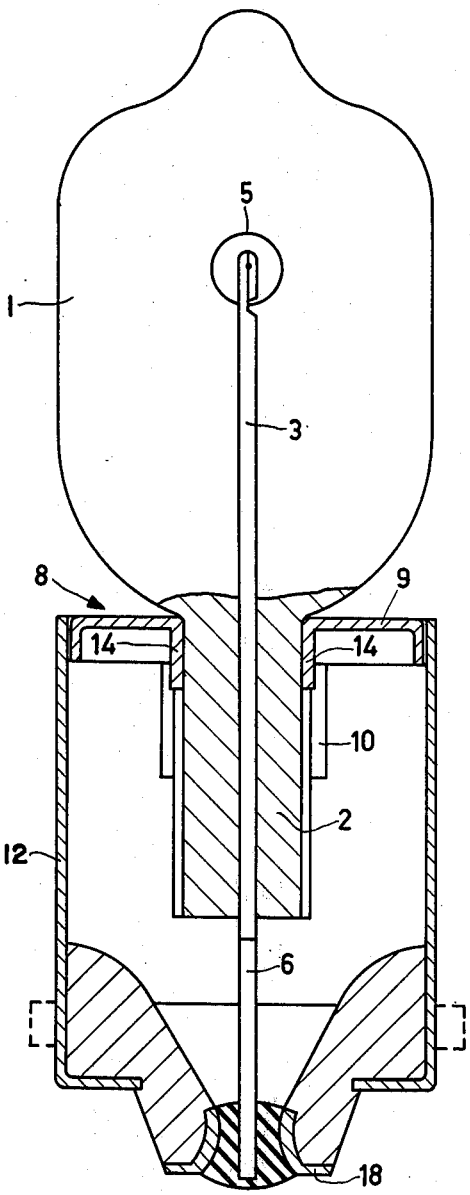
Figure 10:
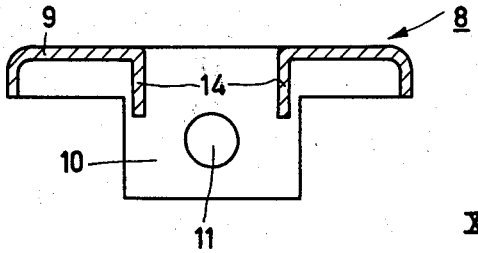
FIG. 10 shows a longitudinal section through the inner part of FIG. 9 along the line X—X.
Figure 11:
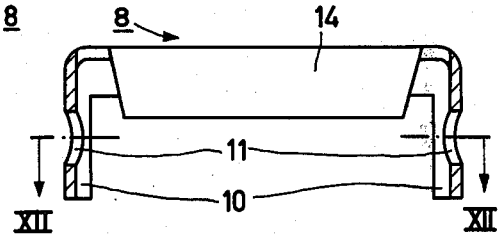
FIG. 11 shows a longitudinal section, turned through 90°, through the inner part along the line XI—XI of FIG. 10.
Figure 9:
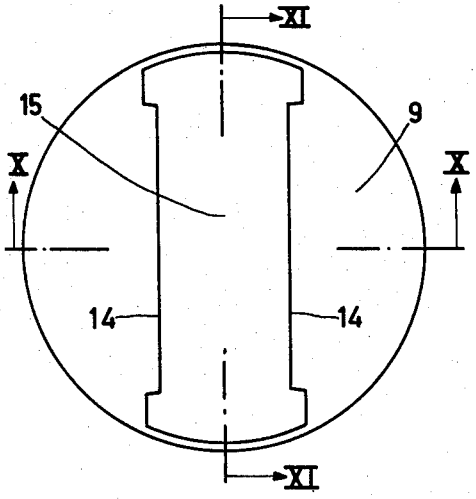
FIG. 9 shows a top view on to the inner part of the lamp of FIGS. 7 and 8 in larger scale.

To accommodate the lamp bulb 1, a metal inner part 8 consists of a round cover plate 9 with three spring clips 10 extending at right angles to it and provided with round openings 11 (FIGS. 4 to 6). The spring clips 10 are arranged in a circle, the diameter of which corresponds approximately to the inside diameter of a metal sleeve-shaped cap 12, into which the inner part 8, together with its spring clips 10, is inserted so as to form a tight fit. For this purpose the cap 12 has three projections 13 protruding inwards, of which only one is visible in FIG. 1 and two are visible in FIG. 2. The spring clips 10 fit over the projections 13 when the inner part 8 is inserted into the cap 12, and lock into position by means of the openings 11 which correspond to the cross-section of the cap. In this way the inner part 8 is mechanically fixed to the cap 12.

The lamp bulb 1 is then inserted into the cover plate 9 of the inner part 8. For this purpose two holding clips 14 are bent inwards at an angle, out of the cover plate 9. The pinch 2 is jammed into the opening 15 thus created of the cover plate 9, until it comes up against the bulb 1. On both its longitudinal sides, the pinch 2 has shoulders extending at right angles to the lamp's longitudinal axis, behind which, when the lamp bulb 1 is inserted, the inner part's 8 holding clips 14, bent in at an angle, spring back after being pressed apart by the pinch 2, so that the lamp bulb 1 is secured with regard to the inner part 8 in the direction of the axis 2. Such a plate is known from U.S. Pat. No. 4,119,877.

So that the clips 10, which in the final position of the inner part 8 in the cap 12 have sprung into position over the projections 13, cannot disengage from the projection 13, the pinch 2 extending at least as far as the projections 13 in the cap 12, and therefore the opening 15 in the cover plate 9 of the inner part 8, is so arranged that one of the narrow lateral faces 17 of the pinch 2 is positioned in such a way in relation to one of the spring clips 10 of the inner part 8, that its distance from the projection 13 protruding through the clip opening 11 is smaller than the thickness of this clip 10 (FIG. 6).

The ends 6 and 7 of the power leads 3 and 4 are then soldered to the cap contacts 18 and 19.

Figure 12:
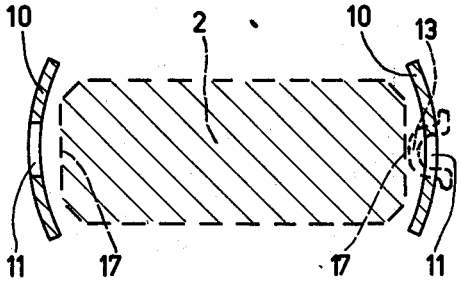
FIG. 12 shows a cross-section through the inner part along the line XII—XII of FIG. 11.

FIGS. 7 to 12 show a version of a lamp according to the invention, in which the inner part 8 is simply provided with two spring clips 10, which combine with two cap projections 13. The same parts have been given the same references as in FIGS. 1 to 6. As can be seen in FIG. 12 in particular, the pinch 2 is situated in this case with its two minor lateral faces 17 each opposite one of the spring clips 10 of the inner part 8. The ends 6 and 7 of the power leads 3 and 4 are connected to the cap contacts 18 and 19 after being tightened, so that the lamp bulb is also secured in the direction of the axis.

What is claimed is:

1. An electric lamp with a bulb and a sleeve-shaped cap, in which an inner part is present, said inner part including means for joining to the sleeve-shaped cap which consists of a cover plate with at least two spring clips extending along the inside wall of the cap and provided with openings which engage elements protruding from the cap, in which the elements protruding into the sleeve-shaped cap are formed in the shape of projections integral with the cap, over which projections, when the inner part is inserted into the cap, the spring clips fit and lock into position, by means of the openings which correspond to the cross section of the projections.

2. A lamp as claimed in claim 1, in which the projections are formed by pressing portions of the metal cap sleeve inwards.

3. A lamp as claimed in either of claims 1 and 2, in which the lamp bulb has a pinch with a generally rectangular cross-section, the pinch extending into the cap at least as far as the projections, and arranged with at least one of its minor lateral faces situated in relation to one of the inner part's spring clips, that its distance from the projection protruding through the clip opening is less than the thickness of this clip.

* * * * *